US005152700A

United States Patent [19]

Bogursky et al.

[11] Patent Number: 5,152,700

[45] Date of Patent: Oct. 6, 1992

[54] PRINTED CIRCUIT BOARD CONNECTOR SYSTEM

[75] Inventors: Robert M. Bogursky, Easton; Robert M. Bradley, Oakville; John E. Jones; Carmine Gugliotti, both of Waterbury, all of Conn.

[73] Assignee: Litton Systems, Inc., Watertown, Conn.

[21] Appl. No.: 715,970

[22] Filed: Jun. 17, 1991

[51] Int. Cl.[5] ..... H01R 13/41

[52] U.S. Cl. ..... 439/733; 439/885

[58] Field of Search ..... 439/733, 746, 757, 885, 439/872, 873

[56] References Cited

U.S. PATENT DOCUMENTS 3,701,967 10/1972 Kreutter ..... 439/748

3,761,871 9/1973 Teurlings et al. ..... 439/751

4,979,903 12/1990 Gosselin ..... 439/885 X 4,996,766 3/1991 Piorunneck et al. ..... 439/885 X 5,030,144 7/1991 Seidler ..... 439/885 X

*Primary Examiner*—Eugene F. Desmond

*Attorney, Agent, or Firm*—Brian L. Ribando

[57] ABSTRACT

A printed circuit board connector includes a daughterboard connector and a pin header. The daughterboard and pin header contacts are secured in their respective housings by interference nibs which are mounted on resilient portions of the contacts. Various constructions are disclosed for separating contact from a carry strip by means of a weakened break-line which will secure the contact to the carry strip during post-manufacturing operations and will form a sharp V-shaped tip when the contact is intentionally removed from the carry strip.

6 Claims, 3 Drawing Sheets

Fig_2
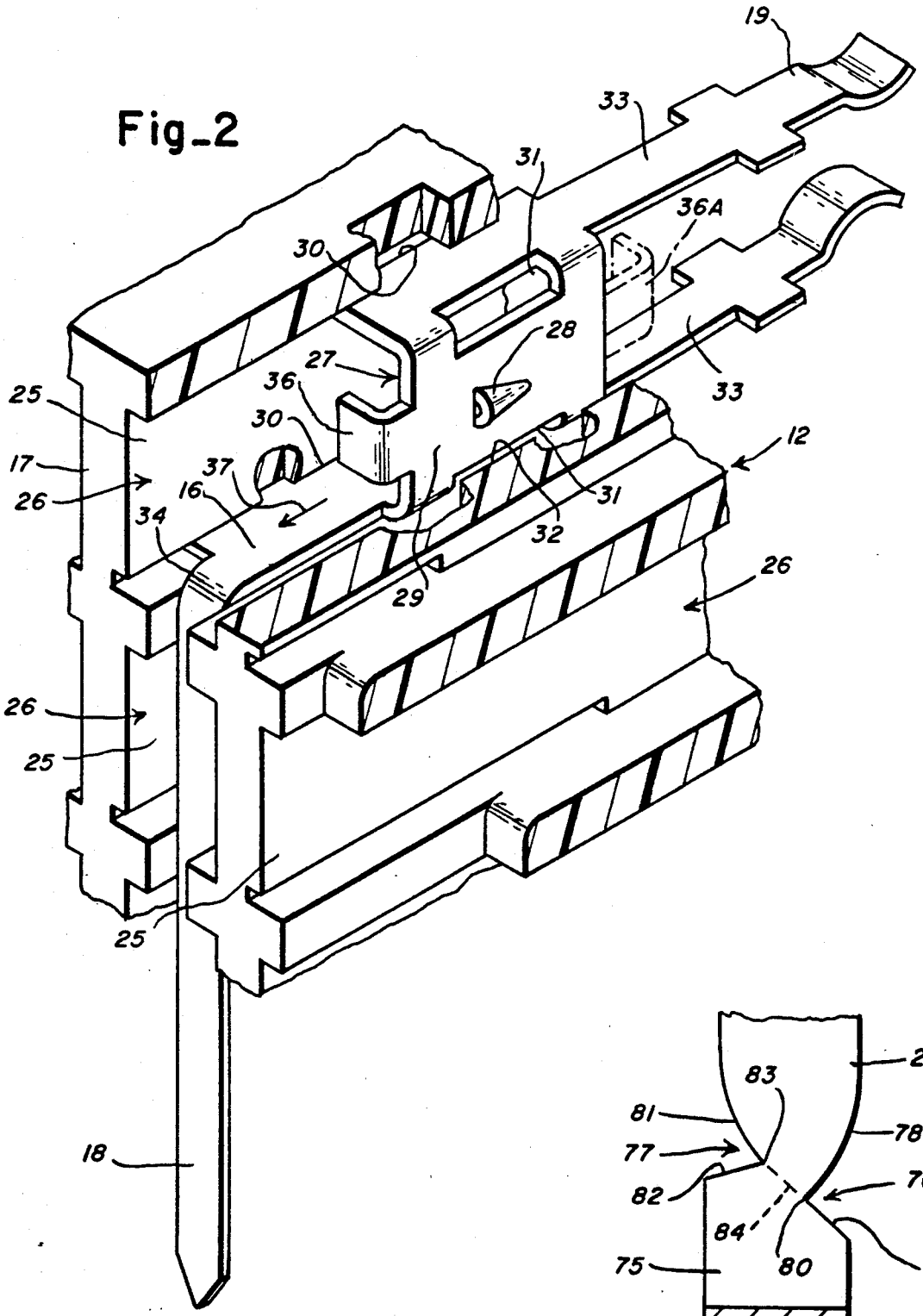
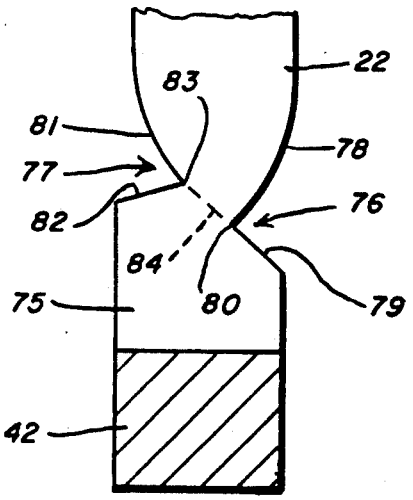
Fig_7

Fig_5
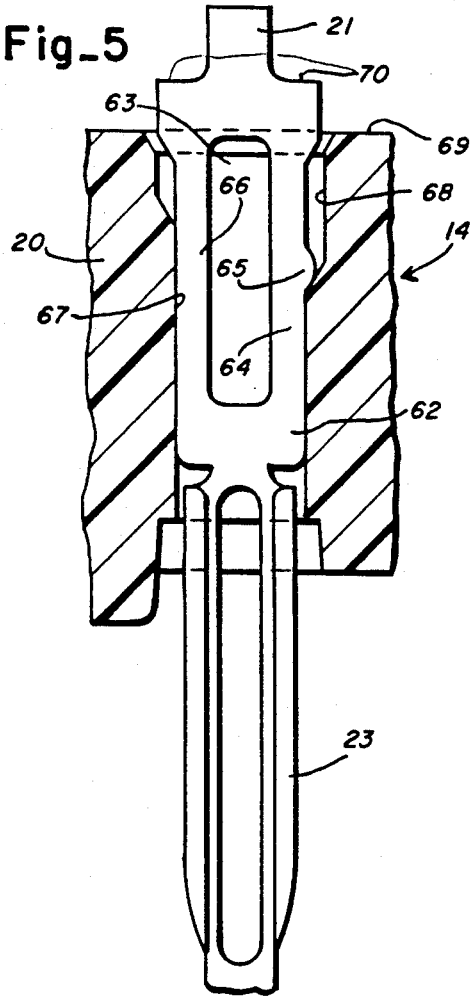
Fig_6
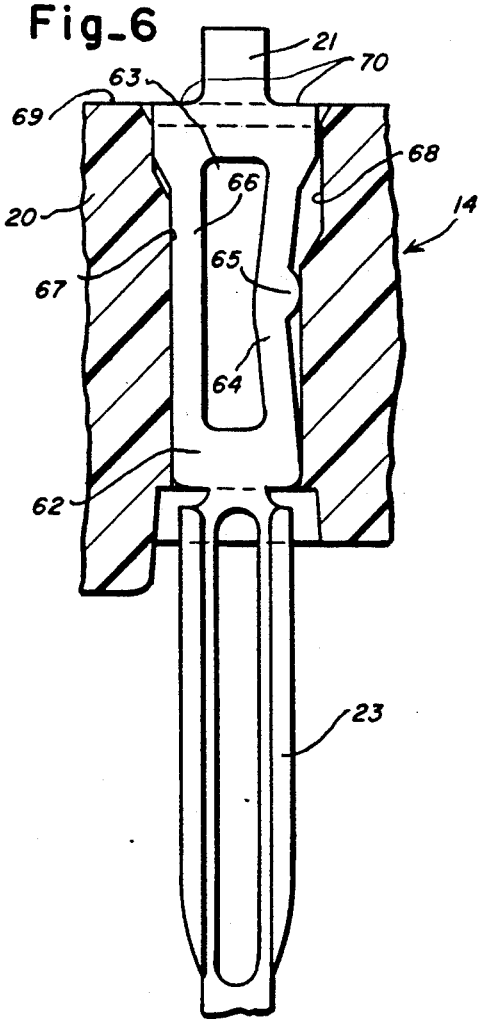
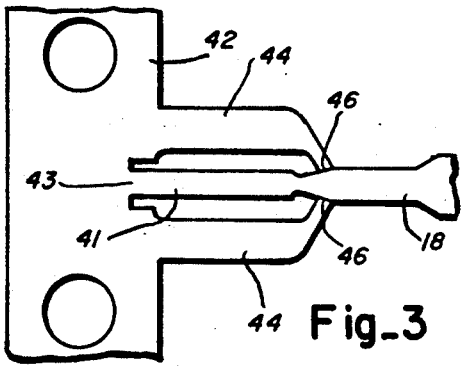
Fig_3
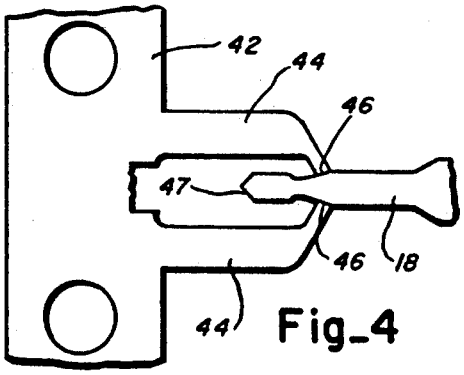
Fig_4

PRINTED CIRCUIT BOARD CONNECTOR SYSTEM

BACKGROUND OF THE INVENTION

This invention relates to printed circuit board connectors used to connect daughterboards to backpanels.

Printed circuit board connectors for coupling daughterboards to backpanels are well known in the art. Such connectors exist in various configurations as, for example, a pin header which is coupled to the backpanel or motherboard and a socket connector which is coupled to the daughtercard. The pin header and socket connector may be mated together to connect the daughtercard to the backpanel and may be disconnected in order to replace one daughtercard with another, for example, for repair purposes. Each connector may contain hundreds of contacts which couple with the contacts of the mating connector and with the daughtercard or backpanel.

A complete assembly may comprise a plurality of daughterboards connected to a single backpanel with all of the daughterboards parallel to one another and perpendicular to the backpanel. In order to achieve this assembly, the daughterboard connectors usually comprise right-angle contacts arranged in rows in a housing, which have a pin end for connection to the plated through holes in the daughterboard and a socket end for mating with the backpanel connector. The backpanel connector is a more simple construction and comprises straight pins, arranged in rows in a housing, which mate with the socket ends of the daughterboard connector and are press fit or soldered to the plated through holes of the backpanel. Each contact requires a mechanism to secure the contact in place in its respective connector housing and a mechanism for removing contacts either for selective loading or for inspection or repair.

In connectors which may be used in a variety of printed circuit daughterboards having different thicknesses, the contacts are required to be a different length depending on the thickness of the board. A dedicated die can be used for each contact length, but this approach is costly and it would be preferable to use a single die to stamp contacts in a standard length which could be trimmed in a secondary operation to produce contacts in varied lengths while still end-carrying the contacts.

In the assembly of pin connectors which attach to backpanels, one carry strip on a preselected number of double end-carried contacts is often broken off to create a comb of contacts which can be gang loaded into the connector housing. The break-line at the end of a contact pin is usually perpendicular to the pin length and this creates a blunt end which is a poor lead-in for either mating the contact with a socket or entry into the plated through holes of a printed circuit board. A short break-line leaves a minimal blunt end but creates a weak attachment to the carry strips, making it prone to damage during manufacturing operations. It would thus be desirable to provide a break-line which is not perpendicular to the pin length, thus producing a better lead-in and stronger attachment to the carry strips.

SUMMARY AND OBJECTS OF THE INVENTION

According to the invention, a daughterboard socket connector comprises a plurality of rows of right-angle contacts which may be made in a single die. The contact tails are end-carried but may be trimmed to different lengths without removing the carry strip in order to accommodate different board thicknesses. Various constructions are used to partially cut and weaken the contact ends so that they may be broken from the carry strips without leaving a blunt end. Retention means are located on resilient portions of the contacts to secure the contacts in their respective housings. The resilient portions allow the use of more crystalline plastics such as polyphenylene sulfide which are desirable for their ability to fill long mold cavities but are prone to cracking and structural failure if too highly stressed. The right-angle daughterboard contact includes a tab designed to accept a probe used to push the contact out of the connector housing for selectively loading housings or for repair purposes.

It is, accordingly, an object of the invention to provide a daughterboard and motherboard connector having contacts which are secured in their respective housings by resiliently supported retention means.

It is another object of the invention to provide daughterboard end carry contacts of varying lengths which may be stamped in a single die.

It is yet another object of the invention to provide a break off structure for separating contact pins from a carry strip which produces a tapered lead-in on the pin end while still providing the required attachment strength to withstand manufacturing operations.

These and other objects of the invention will become apparent from the following detailed description in which reference numerals used throughout the description correspond to reference numerals found on the drawing figures.

BRIEF DESCRIPTION OF THE DRAWINGS

FIG. 2 is a perspective view partly in section of a daughterboard socket contact in a connector housing.

FIGS. 3 and 4 show socket contact tails on a carry strip during the manufacturing process.

FIGS. 5 and 6 are front views, partly in section of a motherboard pin in a connector housing.

FIG. 7 is a side view of a motherboard pin contact attached to a carry strip.

DESCRIPTION OF THE PREFERRED EMBODIMENT

Figure 1:
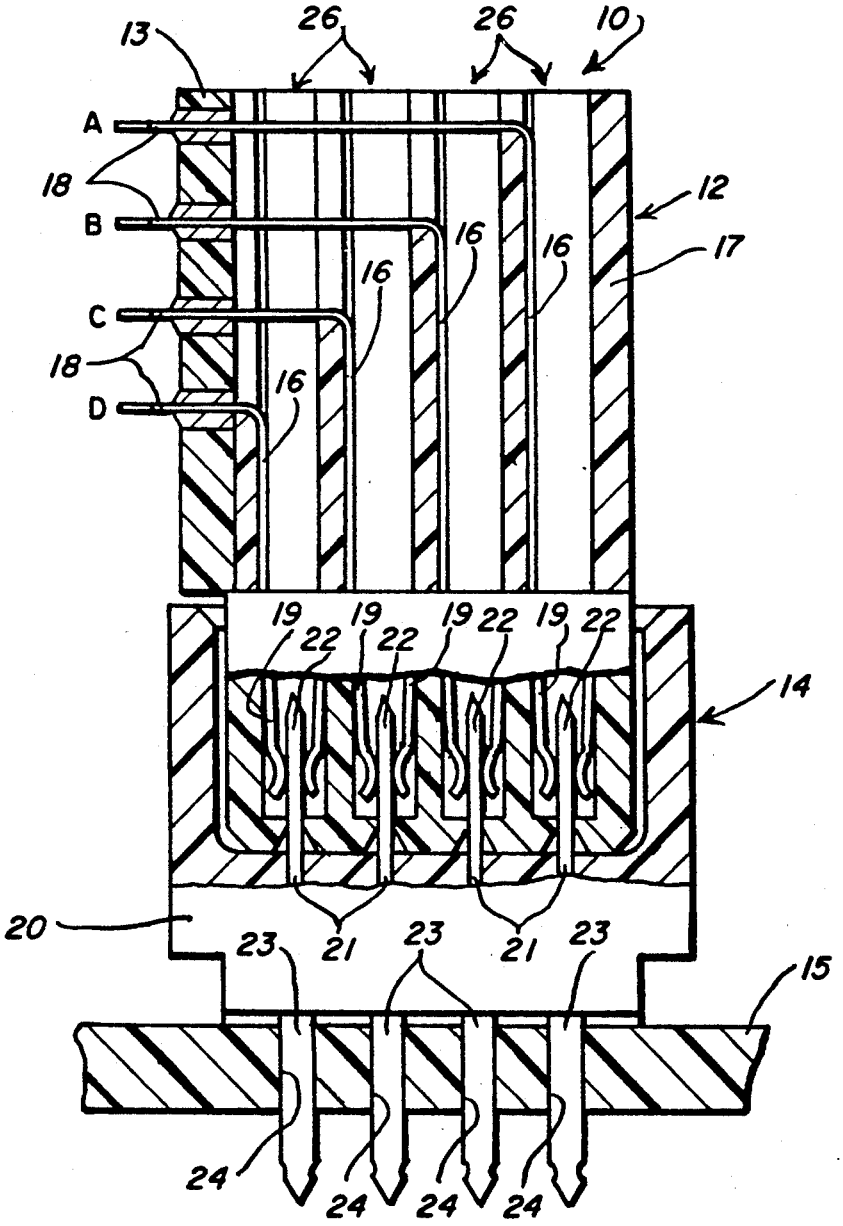
FIG. 1 is a sectional view of a motherboard and daughterboard connector coupled together.

Turning now to the drawing figures, FIG. 1 shows a printed circuit board connector system generally indicated by the reference numeral 10 comprising a socket connector 12 coupled to a daughterboard 13 and a pin header 14 coupled to a backpanel or motherboard 15. The socket connector 12 comprises a housing 17 with four channels 26 and four rows A–D of right-angle contacts 16 each including a contact tail 18 on one end which engages a plated through hole in the daughterboard 13 and a dual beam socket 19 on the opposite end which engages a contact in the pin header 14. The pin header 14 comprises a housing 20 and a plurality of pin contacts 21, each contact comprising an upstanding pin 22 which is received by a socket 19 and a press-fit section 23 which is received by the plated through holes 24 of the motherboard 15.

FIG. 2 is a perspective view partly in section showing a socket contact 16 in the socket connector 12. Each contact 16 is located in a four-sided channel 26 formed in the connector housing 17 and comprises a U-shaped body section 27 including a retention barb 28 formed on the center section 29 of the body which is separated from the rest of the body by two slots 31 formed on the bend areas of the U. Although broken away to provide a full view of the contact 16, it will be appreciated that the vertical wall 32 extends above the U-shaped body section 27 and is engaged by the barb 28 to hold the contact in place within the channel 26. The slots 31 allow the center section 29 to act as a resilient spring which deflects when the barb 28 engages the side wall of the channel 26 and forces the flat edges 30 of the U against the opposite side wall 25 of the channel and into the guide slot 35 to stabilize and locate the contact in the channel. Although not specifically shown, it will be appreciated by those skilled in the art that the slots 31 may also be positioned on other locations on the body 27 which will allow the portion of the center section 29 which supports the barb 28 to act as a resilient spring without departing from the spirit of the invention.

A pair of elongated beams 33 extends from one end of the U-shaped body 27 and forms the contact socket 19. The contact tail 18 extends from the opposite end of the U-shaped body 27 and includes a right-angle bend 34. One end of the U-shaped body 27 also includes a contact depopulation tab 36 which is positioned at right angles to the axis of the U-shaped body and the elongated beams 33. In order to remove the contact 16 from the channel 26, either for selective connector loading or for repair purposes, a probe may be inserted into the channel and advanced until it abuts the depopulation tab 36. Further insertion of the probe into the channel will push the contact from the channel 26 in the direction shown by the reference arrow 37. Once the barb 28 has been pushed out of the channel 26 by pressure on the depopulation tab 36, the contact 16 may be manually removed from the channel 26. Alternatively, a depopulation tab 36A may be located at the other end of the U-shaped body as shown in phantom in FIG. 2. In either location, the depopulation tab not have to be perpendicular to the contact axis as shown as long as it is positioned to receive a force from a probe which is inserted into the channel 26. The depopulation tab may also be engaged to push a contact into a channel 26.

Referring briefly to FIG. 1, it will be appreciated that the length of the contact tails 18 in each of the four contact rows is dependent on the thickness of the printed circuit board 13. A method of achieving various contact tail lengths while manufacturing all the contacts for a single row from a single die is shown in FIG. 3. Referring now to FIG. 3, each contact tail 18 is initially formed with a length of stock material 41 which is coupled to the carry strip 42 at the extreme end 43. Lateral arms 44 extend from the carry strip 42 and are coupled to the tail 18 at scored or weakened attachment points 46 on the tail.

As shown in FIG. 4, a portion of the stock material 41 may be trimmed at a later assembly station leaving a finished tip 47 on the contact tail 18. This method provides the advantage of strengthening the attachment between the contact tail 18 and the carry strip 42 by means of the two lateral arms 44. The lateral arms 44 also allow the contact tail 18 to be severed from the carry strip 42 thus forming the finished tip 47 to give the contact tail the desired length for a selected printed circuit board thickness, while still supporting the tail 18 for plating and reeling operations. In a later operation, the lateral arms 44 may be broken away from the contact tail 18 at the scored areas 46 to completely separate the contact tail 18 from the carry strip 42. It will be appreciated that the stock material 41 may be trimmed at any position between the extreme end 43 and the attachment points 46 to form a contact tail having a desired length.

FIGS. 5 and 6 show a construction for retaining a pin contact 21 in the housing 20 of pin header 14. As shown, the pin contact 21 comprises a flat rectangular body 62 having a slot 63 formed therein. One side 64 of the body 62 is formed with a protruding nib 65 while the opposite side 66 is straight. The body 62 is received in a mounting slot 67 formed in the housing 20. The mounting slot 67 includes a recess 68 which extends part way into the slot 67 from the top surface 69 of the housing 20 and is dimensioned to slidingly receive the nib 65 without interference. FIG. 5 shows the pin contact 21 in a preload position loosely positioned in the mounting slot 67 but not at its final position.

Referring now to FIG. 6, a force may be applied to the shoulders 70 of the pin body 62 to force the nib 65 past the recess 68 into the narrower portion of the mounting slot 67. In this position, the nib 65 compresses the plastic at the side of the mounting slot 67, thus securing the pin body 62 in the housing 20. The slot 63 allows the side 64 to flex forcing the contact against the opposite wall of the mounting slot 67 to position and stabilize the contact. The resilience of the side 64 limits the force applied to the plastic by the nib 65 to prevent cracking the housing 20 while providing adequate retention of the contact in the mounting slot 67.

FIG. 7 shows a preferred method for forming a narrow tip on either the pin end 22 of the pin contacts 21 which engage the sockets 19 of the daughterboard contacts 16 or on the opposite end. FIG. 7 shows a side view of the pin 22, that is, with the carry strip 42 perpendicular to the plane of the paper. As shown, the stock material 75 is provided with a first notch 76 on the front of the stock material 75 and a second notch 77 on the back. The two notches 76 and 77 are not positioned directly opposite one another on the front and back of the stock material 75 but are staggered along the length of the material. As shown, the notch 76 comprises a curved edge 78 and a straight edge 79 which meet at an apex 80, and the notch 77 comprises a curved edge 81 and a straight edge 82 which meet at an apex 83 although the edges of both notches may be curved or straight as desired. The apexes 80 and 83 are joined by a break-line 84 which is skived or otherwise weakened and is oriented at an angle (nonperpendicular) to the sides of the stock material 75. At the desired time, the carrier strip 42 may be broken away from the pin end 22 along the break-line 84 by bending. The length of the break-line 84 is chosen to withstand the handling, plating, and reeling forces imposed on the contacts before they are intentionally separated from the carry strip. Because the break-line 84 is at an angle (nonperpendicular) to the axis of the pin end 22, it does not present a flat, blunt end after contact breakoff which would inhibit entry of the pin into the sockets 19 of the daughterboard contact 16. Moreover, although the break-line 84 is straight, pin end 22 is essentially curved owing to the curved edges 78 and 81.

Having thus described the invention, various alterations and modifications will be apparent to those skilled in the art, which modifications and alterations are intended to be within the scope of the invention as defined by the appended claims.

What is claimed is:

1. A printed circuit board connector comprising a housing and a plurality of contacts in which the housing includes a plurality of channels for receiving the contacts, each contact comprising:

a U-shaped body having a protruding barb positioned on a center section of the body and engaging one of the walls of a channel; and two slots formed in the U-shaped body on either side of the center section, whereby the protruding barb is resiliently supported by the center section.

2. The connector of claim 1 wherein the two slots are formed one each in the bend areas of the U-shaped body.

3. The connector of claim 1 further comprising:

a tab attached to the U-shaped body and positioned along and at an angle to the axis of the contact, whereby the tab may be used to receive a force to push the contact into and out of the channel.

4. A printed circuit board connector including a housing and a contact which is received in a mounting slot formed in the housing, the connector comprising:

a contact having a rectangular body and two opposed sides, a first of said sides having a protruding nib formed thereon and the second of said sides being straight;

a slot formed in the rectangular body between the said two opposed sides, whereby said first of said sides is resilient and deflects in response to a force exerted on said protruding nib;

an elongated flat wall in the mounting slot for receiving the straight side of said rectangular body, whereby the elongated flat wall stabilizes and accurately positions the contact in the mounting slot; and a recess formed in the opposite wall of the mounting slot, said recess being dimensioned to slidingly receive the protruding nib without interference.

5. A printed circuit board contact having a tapered pin end comprising:

a pin end attached by stock material to a carry strip;

a first and second notch separating the pin end from the stock material, each notch having two sides joined at an apex; and a weakened break-line connecting the apexes of the notches, said break-line being disposed at an angle which is nonperpendicular to the axis of the pin.

6. A carry strip and a printed circuit board contact comprising a U-shaped body having an elongated contact tail extending from one end thereof comprising:

a pair of lateral arms extending rom the carry strip;

a pair of attachment points on the contact tail for receiving the pair of lateral arms, wherein the attachment points are oriented at an angle which is nonparallel to the longitudinal axis of the contact tail; and a length of stock material extending from the attachment points to the carry strip, said length of stock material adapted to be trimmed in length to form a finished tip located between the lateral arms, whereby the contact tail remains attached to the carry strip by the lateral arms.

* * * * *